US007266329B2

(12) United States Patent
Matsuo et al.

(10) Patent No.: US 7,266,329 B2
(45) Date of Patent: Sep. 4, 2007

(54) TONER IMAGE CARRYING MEMBER AND MANUFACTURING METHOD THEREOF, AND ELECTROPHOTOGRAPHIC APPARATUS

(75) Inventors: Yasuhiro Matsuo, Kanagawa (JP); Satoshi Kokubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 10/950,388

(22) Filed: Sep. 28, 2004

(65) Prior Publication Data

US 2005/0069351 A1 Mar. 31, 2005

(30) Foreign Application Priority Data

Sep. 29, 2003 (JP) ..... 2003-337447

(51) Int. Cl.
*G03G 15/00* (2006.01)

(52) U.S. Cl. ..... 399/159; 399/162; 399/279; 399/286; 399/302; 399/308

(58) Field of Classification Search ..... 399/159, 399/162, 279, 286, 302, 308
See application file for complete search history.

(56) References Cited

U.S. PATENT DOCUMENTS 4,696,881 A * 9/1987 Saitoh et al. ..... 430/57.7
5,296,895 A * 3/1994 Naito ..... 399/49
5,387,966 A * 2/1995 Karashima ..... 399/286
5,753,348 A * 5/1998 Hatakeyama et al. .... 428/195.1
5,907,745 A 5/1999 Azuma et al. ..... 399/92
6,144,832 A * 11/2000 Nimura et al. ..... 399/328
6,244,588 B1 6/2001 Tsubakimoto et al. ..... 271/164
6,357,740 B1 3/2002 Inoue et al. ..... 271/160
6,382,621 B1 5/2002 Inoue et al. ..... 271/120
6,597,886 B1 * 7/2003 Yoshida ..... 399/302
6,673,407 B2 * 1/2004 Hara et al. ..... 428/36.9
6,681,092 B2 * 1/2004 Terai ..... 399/267
7,149,459 B2 * 12/2006 Kamijo et al. ..... 399/239
2003/0016967 A1 * 1/2003 Ozeki et al. ..... 399/286

FOREIGN PATENT DOCUMENTS

JP 04303870 A * 10/1992
JP 10-142956 5/1998
JP 2005082327 A * 3/2005

* cited by examiner

*Primary Examiner*—David M. Gray
*Assistant Examiner*—Geoffrey T Evans
(74) *Attorney, Agent, or Firm*—Fitzpatrick, Cella, Harper & Scinto

(57) ABSTRACT

A toner image carrying member can be rotationally driven, and a plurality of grooves are formed on an outer peripheral surfaces of the toner image carrying member, the plurality of grooves extending along a rotation direction of the toner image carrying member and arranged in an orthogonal direction perpendicular to the rotation direction, and the configuration of the outer peripheral surface of the toner image carrying member in the orthogonal direction is a periodic uneven-configuration. Also disclosed is a method for manufacturing the toner image carrying member and an electrophotographic apparatus having the toner image carrying member.

8 Claims, 5 Drawing Sheets

TONER IMAGE CARRYING MEMBER AND MANUFACTURING METHOD THEREOF, AND ELECTROPHOTOGRAPHIC APPARATUS

This application claims priority from Japanese Patent Application No. 2003-337447 filed Sep. 29, 2003, which is hereby incorporated by reference herein.

BACKGROUND OF THE INVENTION

1. Field of the Invention

The present invention relates to a toner image carrying member, such as an electrophotographic photosensitive member and an intermediate transfer member, and a method for manufacturing the toner image carrying member, and an electrophotographic apparatus having the toner image carrying member.

2. Description of the Related Art

There are various types of so-called electrophotographic apparatuses, that is, image forming apparatuses employing an electrophotographic system. Directing attention to the transfer method employed, for example, there are electrophotographic apparatuses employing a method in which a toner image is transferred directly from an electrophotographic photosensitive member to a transfer material (such as paper and OHT) or those employing a method (intermediate transfer method) in which a toner image is primarily transferred from an electrophotographic photosensitive member to an intermediate transfer member, and then secondarily transferred from the intermediate transfer member to a transfer material.

A significant problem arising in connection with electrophotographic apparatuses is how to reliably clean away (remove) toner (hereinafter referred to as "transfer residual toner") that remains on an outer peripheral surface of a toner image carrying member such as an electrophotographic photosensitive member and an intermediate transfer member without being transferred (including both primary transfer and secondary transfer).

As a method for cleaning transfer residual toner from an outer peripheral surface of a toner image carrying member, there is known one in which the transfer residual toner is removed by scraping off with a cleaning blade put on the outer peripheral surface of the toner image carrying member (hereinafter referred to as "blade cleaning method"). As a technique to achieve improved cleaning performance in the blade cleaning method, for example, JP 10-142956 A discloses a technique of making the ten-point average roughness of the surface of the intermediate transfer member be not larger than 3.5 μm.

However, when the inventors of the present invention conducted a cleaning performance test by using in combination the blade cleaning method and an intermediate transfer member (an intermediate transfer belt) shaped into an endless belt and whose outermost layer (the layer nearest to the outer peripheral surface) was formed through dip coating and whose outer peripheral surface had a ten-point average roughness of 0.1 μm, the cleaning blade got entangled in the rotating intermediate transfer belt during the test, resulting in damage.

That is, while the cleaning blade can remove transfer residual toner in a favorable manner when a toner image carrying member such as an intermediate transfer member is formed to have an outer peripheral surface that is highly smooth, such an arrangement also involves a problem in that the cleaning blade becomes more liable to be entangled in the toner image carrying member that is rotating.

In particular, when the outermost layer of the toner image carrying member is formed as a coating layer (layer formed through coating of a coating liquid), depending on the physical property of the coating liquid, the outermost layer surface, that is, the outer peripheral surface of the toner image carrying member may become extremely smooth, and the cleaning blade becomes more liable to be entangled in the toner image carrying member more for that.

SUMMARY OF THE INVENTION

An object of the present invention is to provide a toner image carrying member which can ensure high cleaning performance and also suppress entanglement of a cleaning blade when used in an electrophotographic apparatus employing a blade cleaning system, a method for manufacturing the toner image carrying member, and an electrophotographic apparatus equipped with the toner image carrying member.

That is, the present invention relates to a toner image carrying member on which a toner image is carried and which can be rotationally driven, wherein: the toner image carrying member comprises a plurality of grooves formed on an outer peripheral surface of the toner image carrying member, the plurality of grooves extending along a rotation direction of the toner image carrying member, and arranged in an orthogonal direction which crosses to the rotation direction at right angles; and a configuration of the outer peripheral surface of the toner image carrying member in the orthogonal direction is periodic uneven-configuration.

Further, the present invention relates to a method for manufacturing a toner image carrying member on which a toner image is carried and which can be rotationally driven, the toner image carrying member comprising a plurality of grooves formed on an outer peripheral surface of the toner image carrying member, and a coating layer serving as an outermost layer, the plurality of grooves extending along a rotation direction of the toner image carrying member, and arranged in an orthogonal direction which crosses to the rotation direction at right angles, and the outer peripheral surface of the toner image carrying member shaped into a periodic uneven-configuration in the orthogonal direction, the method comprising the steps of: coating a coating liquid for forming the coating layer to an outer surface of a target object; and curing the coating liquid by giving an energy to the coating liquid coated in the step of coating, wherein the step of curing comprises curing the coating liquid while producing a distribution of regions with different densities of the energy on the outer peripheral surface of the coating liquid that was coated in the step of coating.

Further, the present invention relates to an electrophotographic apparatus wherein the apparatus comprises the toner image carrying member described above.

DETAILED DESCRIPTION OF THE PRESENT INVENTION

Hereinafter, the present invention is described in detail.

As aforementioned, a toner image carrying member of the present invention has a plurality of grooves formed on an outer peripheral surface thereof so as to extend along the rotation direction of the toner image carrying member (hereinafter simply referred to as the "rotation direction"). Further, the plurality of grooves are arranged in a direction which crosses to the rotation direction at right angles (hereinafter simply referred to as the "orthogonal direction"). The outer peripheral surface of the toner image carrying member thus has a periodically uneven configuration as seen in the orthogonal direction.

Figure 1:
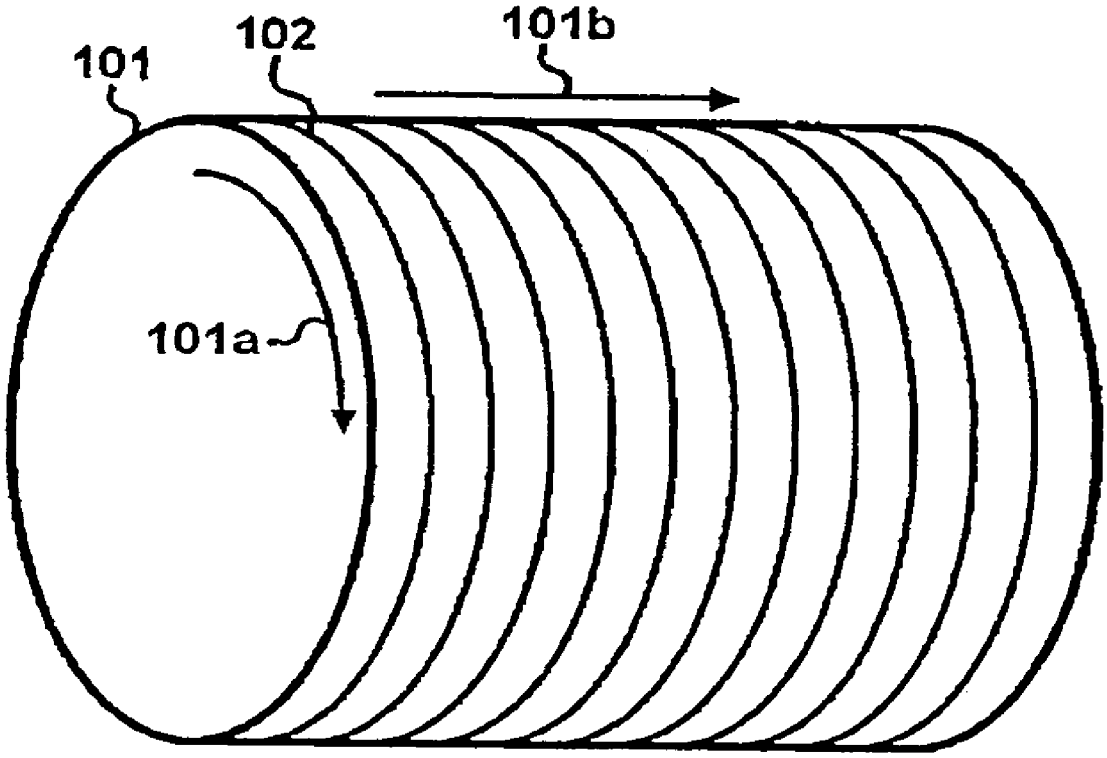
FIG. 1 is a view schematically showing an outer peripheral surface of a toner image carrying member.
Figure 2:
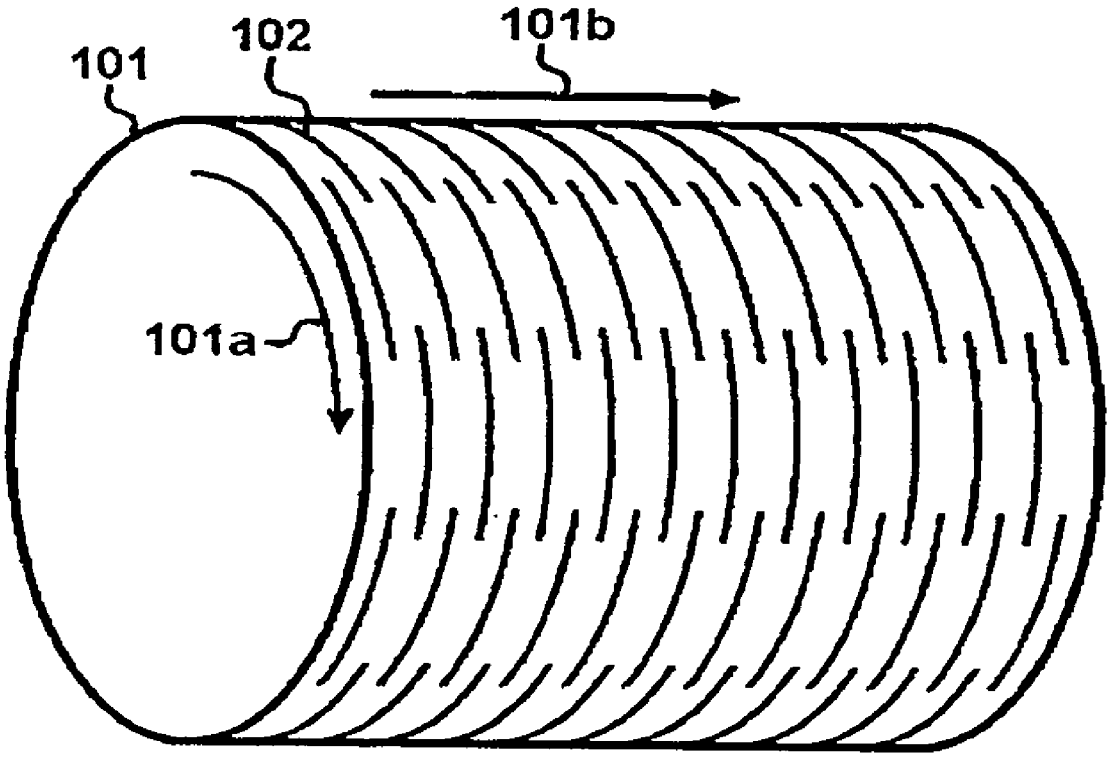
FIG. 2 is a view schematically showing another outer peripheral surface of the toner image carrying member.

FIGS. 1 and 2 each schematically exemplify an outer peripheral surface of the toner image carrying member according to the present invention.

Referring to FIGS. 1 and 2, denoted by 101 is a toner image carrying member, 101*a* is a rotation direction (the rotation direction of the toner image carrying member 101), 101*b* is an orthogonal direction (the direction which crosses at right angles to the rotation direction 101*a* of the toner image carrying member 101), and 102 is each of a plurality of grooves formed along the rotation direction 101*a* of the toner image carrying member 101. The plurality of grooves 102 are arranged in ranks in the orthogonal direction 101*b*. While FIGS. 1 and 2 provide somewhat simplified illustrations such as the number of the grooves 102, for convenience of the description, the present invention is not limited to the specific forms illustrated in FIGS. 1 and 2.

In the present invention, it suffices that the plurality of grooves 102 be arranged in ranks in the orthogonal direction 101*b*; for example, as shown in FIG. 1, the grooves 102 may be formed so as to extend continuously without interruption along the rotation direction 101*a*, or, as shown in FIG. 2, the grooves 102 may be formed such that areas with the groove 102 and areas without the groove 102 are alternately present. Further, as shown in FIG. 1, in the present invention, the grooves may be formed such that, the number of grooves per unit length in the orthogonal direction 101*b* (i.e., a period of the unevenness) is the same regardless of the position where the number is counted, or, as shown in FIG. 2, the grooves may be formed such that the number of grooves per unit length in the orthogonal direction 101*b* (the period of the unevenness) varies depending on the position where the number is counted. In the region of the outer peripheral surface of the toner image carrying member on which the cleaning blade puts, the number of grooves per unit length in the orthogonal direction 101*b* (the period of the unevenness) is preferably in the range of 50 to 5,000 $cm^{-1}$, and more preferably, in particular, in the range of 100 to 200 $cm^{-1}$.

Figure 3:
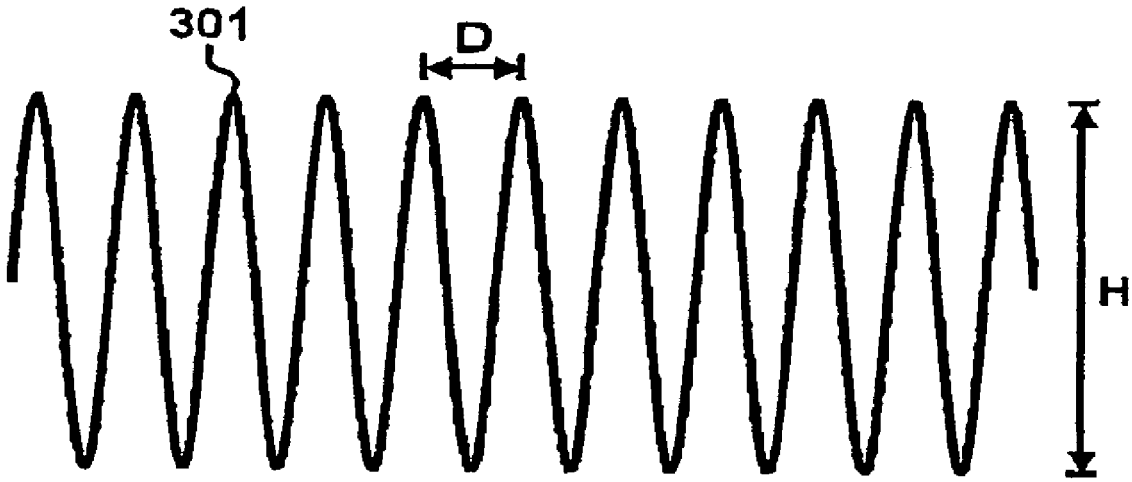
FIG. 3 is a view showing an example of a configuration in which unevennesses repeatedly appear.
Figure 4:
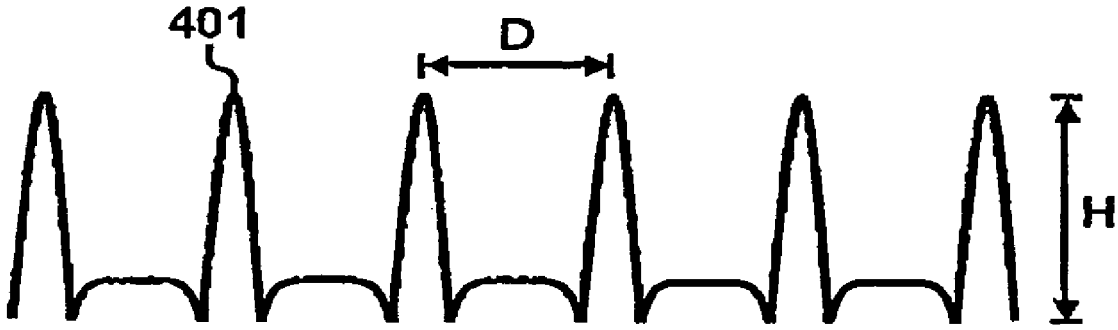
FIG. 4 is a view showing another example of a configuration in which unevennesses repeatedly appear.

There are no particular limitations on the configuration of the unevennesses in the orthogonal direction of the outer peripheral surface of the toner image carrying member. FIGS. 3 and 4 each show a configuration in which such unevennesses repeatedly appear. Referring to FIGS. 3 and 4, denoted by 301 and 401 are each a configuration in the orthogonal direction of the outer peripheral surface of the toner image carrying member, and denoted by H is the depth of the grooves (amplitude of the unevenness). D denotes the distance between adjacent projections, equivalent to the distance between adjacent grooves. When, as shown in FIG. 4, the configuration of the unevennesses is not constant, the difference in height between the most elevated part of a projection and the deepest part of a depression is taken as the depth of a groove (an amplitude of the unevenness) H. Further, the distance between the respective projections which are most elevated is taken as the distance between the adjacent projections D, which is regarded as the distance between adjacent grooves.

When the toner image carrying member formed the grooves and the configuration as described above on the outer peripheral surface thereof is provided, not only is it possible to reduce the contact area between the toner image carrying member and the cleaning blade but also the contact area between the toner image carrying member and the cleaning blade can be maintained virtually constant even when the toner image carrying member is rotationally driven, whereby the putting states and sliding states of the cleaning blade with respect to the toner image carrying member can be stabilized. Accordingly, it is possible to prevent the cleaning blade from being entangled in the toner image carrying member that is rotating.

From the viewpoint of cleaning (removing) toner from the outer peripheral surface of the toner image carrying member in a stable and satisfactory manner, it is preferable that the amplitude of the unevennesses (the depth of the grooves) and the distance between adjacent grooves in the uneven-configuration of the outer peripheral surface of the toner image carrying member are smaller than the average particle size of the toner used. Specifically, since the average particle size of the toner typically used is several μm, the amplitude of the unevennesses (the depth of the grooves) is preferably within a range of 0 2 to 1.0 μm, and more preferably, in particular, not larger than 0.6 μm. Further, the distance between adjacent grooves is preferably within the range of 50 to 100 μm. Setting the amplitude of the unevennesses (the depth of the grooves) and the distance between adjacent grooves within the above-specified ranges is also effective in stabilizing the putting states and sliding states of the cleaning blade.

While the toner image carrying member of the present invention can take various shapes, such as a belt-like or drum-like shape, preferred is the belt-like shape which increases the degree of freedom in placing the toner image carrying member inside the electrophotographic apparatus, thus making it possible to achieve miniaturization of the electrophotographic apparatus main body through effective utilization of space and cost reduction.

Further, for provide the toner image carrying member having the outer peripheral surface with the grooves and the configuration as described above, it is preferable, from the viewpoint of the ease of control on the outer peripheral surface configuration, to form the outermost layer of the toner image carrying member by coating. Specifically, a wet film is formed by coating a coating liquid onto a target object (an object immediately before forming the outmost layer of a toner image carrying member). Then, when applying energy for curing the coating liquid (the wet film) to the coating liquid, by making different from the density of energy (amount of energy per unit area) applied to portions that are to become depressions and the density of energy applied to portions that are to become projections, that is, by curing the coating liquid while producing a distribution of regions with different energy densities, the grooves and the configuration as described above can form on the outer peripheral surface of the toner image carrying member. The regions with different energy densities can be formed by, for example, applying the above-mentioned curing energy to the coating liquid through a mask having long, narrow openings formed in suitable widths and at suitable intervals and arranged in a suitable manner (slits). The mask is placed on the coating liquid so that the longer side direction of the slit is along the rotation direction of the toner image carrying member. The kind of energy to be applied to the coating liquid may be selected as appropriate according to the kind of the binding material (such as resin) present in the coating liquid (wet film). For example, when a photosetting binding material is contained in the coating liquid, light energy may be used as the energy applied, and when a thermosetting binding material is contained in the coating liquid, thermal energy may be used as the energy applied.

Other examples of the method for forming the grooves and the configuration as described above on the outer peripheral surface of the toner image carrying member include a method of mixing fine particles in the coating liquid for forming the outermost layer of the toner image carrying member, a method of machining the outer peripheral surface of the toner image carrying member, and a method of forming a wet film by coating the coating liquid for forming the outermost layer to the target object, and putting a saw-toothed tool having shape periodicity to the wet layer to thereby transfer the saw-toothed configuration to the surface of the wet film (outer peripheral surface).

However, in case of the method of mixing fine particles in the coating liquid that forms the outermost layer, although it is easy to form periodic unevennesses in the orthogonal direction of the outer peripheral surface of the toner image carrying member, it is difficult to form a plurality of grooves along the rotation direction.

Further, in case of the method of machining the outer peripheral surface, the surface configuration that can be obtained through the machining is one that reflects the tip-end configuration of the mechanical machining tool used. Accordingly, although it is easy to form a plurality of grooves along the rotation direction on the outer peripheral surface of the toner image carrying member, it is difficult to form a periodic uneven-configuration in the orthogonal direction.

Further, in case of the method of transferring the saw-toothed configuration to the surface (outer peripheral surface) of the wet film, when curing the coating liquid (wet film) after transferring the saw-toothed configuration, whether or not the thus transferred saw-toothed configuration can be retained largely depends on the physical property of the coating liquid. Accordingly, the method lacks a wide use.

Further, a skin layer (thin film) may be formed in the immediate surface of the outermost layer of the toner image carrying member according to the present invention. The skin layer is formed by an additive, which is contained in the coating liquid for forming the outermost layer, locally concentrating on the outer peripheral surface side of the toner image carrying member. The additive in the coating liquid often undergoes such localized concentration through interaction with a binding material in the coating liquid, etc. Depending on the kind of the additive used, an improvement is often attained in terms of electrophotographic characteristics.

From the viewpoint of achieving improved cleaning performance and improved slidability of the cleaning blade, it is preferable that the outer peripheral surface of the toner image carrying member of the present invention exhibit high water-repellency (releasability). Specifically, it is preferable that the contact angle of the outer peripheral surface of the toner image carrying member with respect to pure water is not smaller than 90 degrees, and more preferably not smaller than 95 degrees, in particular.

Figure 5:
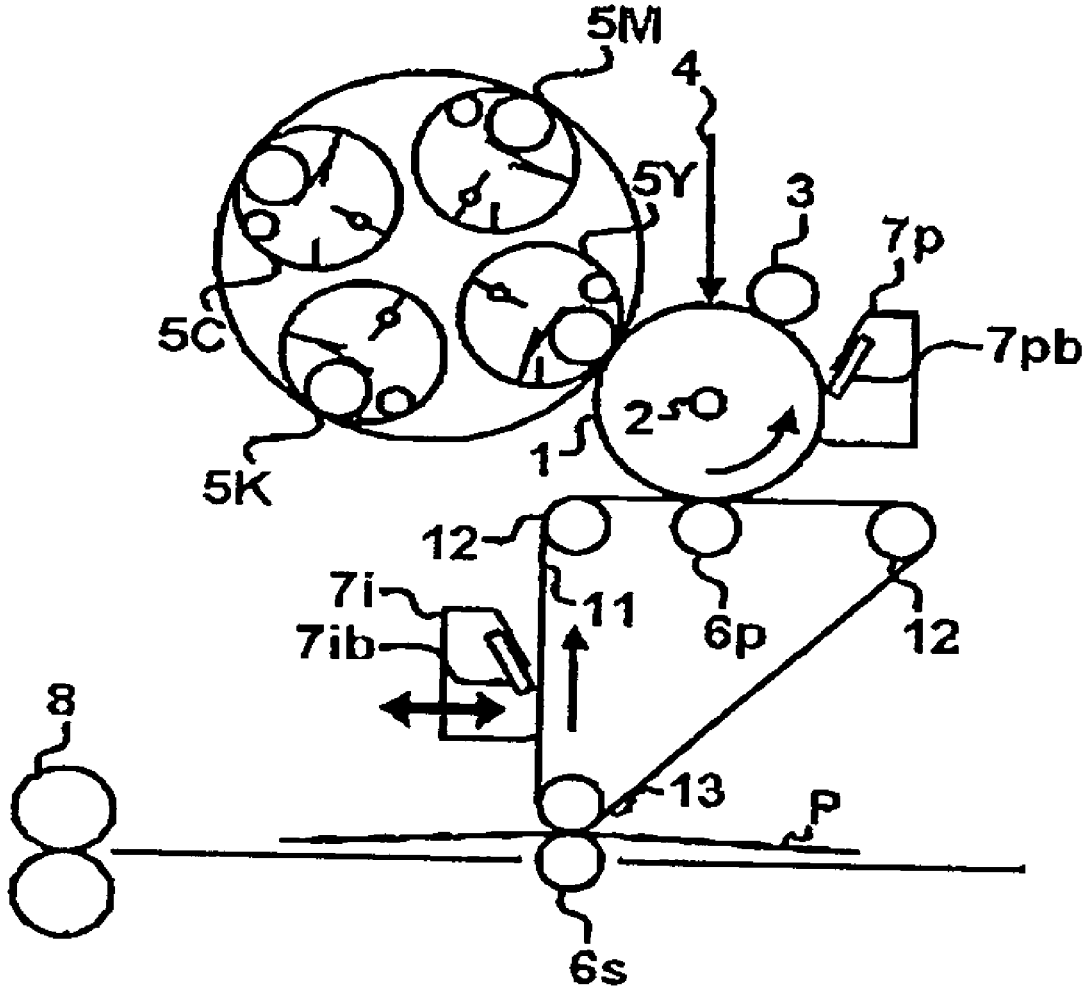
FIG. 5 is a view showing an example of the schematic construction of an electrophotographic apparatus using the toner image carrying member of the present invention shaped into an endless belt and used as an intermediate transfer belt.

FIG. 5 shows an example of the schematic construction of an electrophotographic apparatus in which the toner image carrying member of the present invention shaped into an endless belt is used as an intermediate transfer belt (an intermediate transfer member shaped into an endless belt).

Referring to FIG. 5, reference numeral 1 denotes an electrophotographic photosensitive member of a cylindrical shape, which is driven to rotate in the direction of the arrow around a shaft 2 at a predetermined circumferential speed.

An outer peripheral surface of the electrophotographic photosensitive member 1 that is rotationally driven is uniformly charged by a charging means 3 (primary charging means constituted by a charging roller or the like) to a predetermined positive or negative potential, and then exposed to an exposure light (image exposure light) 4 output from exposure means (not shown) for performing slit exposure, laser beam scan exposure, or the like. The exposure light used at this time is one corresponding to a first color component image (for example, is a yellow component image) of a target color image. In this way, each first color component electrostatic latent image (yellow component electrostatic latent image) corresponding to the first color component image of the target color image is formed gradually on the outer peripheral surface of the electrophotographic photosensitive member 1.

An intermediate transfer belt 11 tensioned by a tension roller 12 and an opposing secondary transferring roller 13 is driven to rotate in the direction of the arrow at substantially the same circumferential speed as the electrophotographic photosensitive member 1 (for example, at 97% to 103% with respect to the circumferential speed of the electrophotographic photosensitive member 1).

The first color component electrostatic latent image formed on the outer peripheral surface of the electrophotographic photosensitive member 1 is developed with a first-color toner (yellow toner) contained in the developer retained by first-color developing means (developing means for yellow-color) 5Y, thereby forming a first-color toner image (yellow toner image). Subsequently, the first-color toner image formed and carried on the outer peripheral surface of the electrophotographic photosensitive member 1 is successively subjected to primary transfer onto an outer peripheral surface of the intermediate transfer belt 11 passing between the electrophotographic photosensitive member 1 and a primary transfer member (primary transferring roller) 6*p* by means of a primary transfer bias from the primary transfer member 6*p*.

After thus transferring the first-color toner image, any residual developer (toner) remaining after the primary transfer is removed by cleaning means 7*p* for the electrophotographic photosensitive member (7*pb* indicates a cleaning blade) from the outer peripheral surface of the electrophotographic photosensitive member 1. After thus cleaning, the outer peripheral surface of the electrophotographic photosensitive member 1 is used for image formation of the next color.

A second-color toner image (magenta toner image), a third-color toner image (cyan toner image), and a fourth-color toner image (black toner image) are formed in the same manner as the first-color toner image on the outer peripheral surface of the electrophotographic photosensitive member 1 by the charging means 3, an exposure light 4 (an exposure light corresponding to the second color component), and second-color developing means 5M; the charging means 3, an exposure light 4 (an exposure light corresponding to the third color component), and third-color developing means 5C; and the charging means 3, an exposure light 4 (an exposure light corresponding to the fourth color component), and fourth-color developing means 5K; respectively, and then successively transferred to the outer peripheral surface of the intermediate transfer belt 11. A composite toner image corresponding to the target color image is thus formed on the outer peripheral surface of the intermediate transfer belt 11. During the primary transfer of the first to fourth colors, a secondary transfer member (secondary transferring roller) 6*s* and a cleaning blade 7*ib* of a cleaning means 7*i* for the intermediate transfer belt are spaced apart from the outer peripheral surface of the intermediate transfer belt 11.

The composite toner image thus formed on the outer peripheral surface of the intermediate transfer belt 11 is successively subjected to secondary transfer onto a transfer material (e.g. paper) P fed out in synchronism with the rotation of the intermediate transfer belt 11 from transfer material supplying means (not shown) into a position (putting part) between the opposing secondary transferring roller 13/intermediate transfer belt 11 and the secondary transfer member 6*s* by means of a secondary transfer bias from the secondary transfer member 6*s*.

The transfer material P to which the composite toner image has been transferred is separated from the outer peripheral surface of the intermediate transfer belt 11 and then introduced to fixing means 8 for image fixing, to be printed out as a color-image output (a print or copy) to the exterior of the apparatus.

After the composite toner image is thus transferred, the cleaning blade 7*ib* of the cleaning means 7*i* for the intermediate transfer belt is putting on the outer peripheral surface of the intermediate transfer belt 11, and any developer (toner) remaining after the secondary transfer is removed from the outer peripheral surface by the cleaning blade 7*ib*. Thus, the outer peripheral surface of the intermediate transfer belt 11 is cleaned.

After having removed therefrom, the outer peripheral surface of the electrophotographic photosensitive member 1 after removing of the transfer residual developer (toner) by the cleaning means 7*p* for the electrophotographic photosensitive member may be subjected to charge elimination by using pre-exposure light from pre-exposure means. However, when, as shown in FIG. 5, the charging means 3 is contact charging means using a charging roller or the like, such pre-exposure is not necessarily required.

It is to be noted that the toner image carrying member of the present invention may be used either as an intermediate transfer member as described above or as any other member carried a toner image (such as a transfer material conveyor member and an electrophotographic photosensitive member) involving cleaning (removal) of toner with a cleaning blade.

Further, the term "toner image" as used herein refers not only to an image of a toner to be obtained in the form of a print or copy as a final output but also to a toner patch or the like to be formed on the outer peripheral surface of a transfer material conveyor member or the like, for example.

EXAMPLES

Hereinafter, the present invention is described in more detail with reference to specific examples. However, the present invention is not limited to those examples.

Endless belts 1 to 12 were prepared according to the procedures described below.

Example 1

Manufacture of Endless Belt 1

A sheet of 50 μm in thickness made of polyvinylidene fluoride (available from Kureha Chemical Industry Co., Ltd.) having carbon black dispersed therein was wound by two turns on the outer periphery of an aluminum cylinder, followed by fitting into a SUS cylinder capable of fitting on while leaving a slight gap (100 μm or slightly more). The sheet was then held between the aluminum cylinder on the inner side and the SUS cylinder on the outer side.

Next, with the sheet being held between the aluminum cylinder and the SUS cylinder, the sheet was uniformly heated up to a melting temperature of polyvinylidene fluoride and then cooled, thus obtaining an endless belt base having a thickness of 100 μm. It is to be noted that the inner peripheral surface of the SUS cylinder was machined by cutting into a finished surface having a saw-toothed configuration with a period of 20 μm and an amplitude of 1 μm in the widthwise direction (in the direction parallel to an axis of the SUS cylinder) of the cylinder. This configuration of the inner peripheral surface of the SUS cylinder was transferred to the outer peripheral surface of the endless belt base.

A solution of an acrylic resin (available from Dainippon Ink and Chemicals Incorporated) with a fluorine atom arranged as a functional group of polymer was coated onto the outer peripheral surface of the endless belt base by dip coating, and then left to stand for ten minutes in an electric furnace maintained at 80° C. The endless belt 1 having a surface layer of 1 μm in average film thickness was thus obtained. The endless belt 1 has a two-layer structure consisting of the base and the surface layer.

The outer peripheral surface of the endless belt 1 thus formed had a configuration substantially like those exemplified in FIGS. 1 and 4. While the outer peripheral surface of the endless belt base had a non-continuous saw-toothed configuration, the outer peripheral surface of the endless belt 1 obtained after the formation of the surface layer had an uneven-configuration which extends smoothly and continuous.

Comparative Example 1

Manufacture of Endless Belt 2

An endless belt was prepared in the same manner as the endless belt 1 except for changing the acrylic resin containing a fluorine atom arranged as a functional group of polymer, which was used in forming the surface layer of the endless belt 1, to an acrylic resin (available from JSR Corporation) containing inorganic fine particles dispersed therein, thus obtaining the endless belt 2.

The outer peripheral surface of the endless belt 2 was relatively smooth, with no shape periodicity confirmed in its configuration.

Comparative Example 2

Manufacture of Endless Belt 3

An endless belt was prepared in the same manner as the endless belt 1 except for changing the acrylic resin containing a fluorine atom arranged as a functional group of polymer, which was used in forming the surface layer of the endless belt 1, to an acrylic resin (available from Sumitomo Osaka Cement Co., Ltd) containing fine particles dispersed therein, thus obtaining the endless belt 3.

The outer peripheral surface of the endless belt 3 was relatively smooth, with no shape periodicity confirmed in its configuration.

Comparative Example 3

Manufacture of Endless Belt 4

An endless belt was prepared in the same manner as the endless belt 1 except for changing the acrylic resin containing a fluorine atom arranged as a functional group of polymer, which was used in forming the surface layer of the endless belt 1, to an acrylic resin (available from Shin-Etsu Chemical Co., Ltd.), thus obtaining the endless belt 4.

The outer peripheral surface of the endless belt 4 was relatively smooth, with no shape periodicity confirmed in its configuration.

Example 2

Manufacture of Endless Belt 5

A sheet of 50 μm in thickness made of polyvinylidene fluoride (available from Kureha Chemical Industry Co., Ltd.) having carbon black dispersed therein was wound by two turns on the outer periphery of an aluminum cylinder, followed by fitting into a SUS cylinder capable of fitting on while leaving a slight gap. The sheet was then held between the aluminum cylinder on the inner side and the SUS cylinder on the outer side.

Next, with the sheet being held between the aluminum cylinder and the SUS cylinder, the sheet was uniformly heated up to a melting temperature of polyvinylidene fluoride and then cooled, thus obtaining an endless belt base having a thickness of 100 μm. It is to be noted that the inner peripheral surface of the SUS cylinder was machined by buffing, forming a smooth, mirror-finished surface in the widthwise direction of the cylinder.

A solution of an acrylic resin (available from JSR Corporation) added with a water-repellent silicone resin was coated to the outer peripheral surface of the endless belt base by dip coating, thus forming a wet film. A mask having a plurality of slits arranged in ranks (hereinafter simply referred to as the "mask having the slits") was then placed on the wet film (coating liquid) along the circumferential direction (rotation direction) of the endless belt. An ultraviolet ray with an illuminance of 100 mJ/cm$^2$ was applied to the wet film through the mask, thus obtaining the endless belt 5. Note that, the mask was placed so that the longer side direction of the slit was along the rotation direction of the toner image carrying member.

A skin layer formed by localized concentration of the water-repellent silicone resin was formed in the immediate surface of the endless belt 5. The endless belt 5 has a two-layer structure consisting of the base and the surface layer (if the skin layer is also counted, the endless belt has three-layer structure in total, because the surface layer can be separated into the skin layer and the other, non-skin layer).

The pitch of the slits of the mask was 200 μm, and a ratio between the slit width and the width of a portion which is not the slit was 1:1.

The outer peripheral surface of the endless belt 5 had a configuration substantially like those exemplified in FIGS. 1 and 4.

Example 3

Manufacture of Endless Belt 6

An endless belt was prepared in the same manner as the endless belt 5 except for changing the mask having the slits to one having a slit pitch of 100 μm (a ratio between the slit width and the width of a portion which is not the slit was 1:1), thus obtaining the endless belt 6.

The outer peripheral surface of the endless belt 6 had a configuration substantially like those exemplified in FIGS. 1 and 4.

Example 4

Manufacture of Endless Belt 7

An endless belt was prepared in the same manner as the endless belt 5 except for changing the mask having the slits to one in which the slits were arranged so that the slit and a portion which is not the slit were alternately arranged in the rotation direction of the endless belt (the slit pitch of the mask: 100 μm, a ratio between the slit width and the width of a portion which is not the slit was 1:1), thus obtaining the endless belt 7.

The outer peripheral surface of the endless belt 7 had a configuration substantially like those exemplified in FIGS. 2 and 4.

Example 5

Manufacture of Endless Belt 8

An endless belt was prepared in the same manner as the endless belt 5 except for changing the mask having the slits to one in which the slits were arranged so that the slit and a portion which is not the slit are alternately arranged in the rotation direction of the endless belt (the slit pitch of the mask: 50 μm, a ratio between the slit width and the width of a portion which is not the slit was 1:1), thus obtaining the endless belt 8.

The outer peripheral surface of the endless belt 8 had a configuration substantially like those exemplified in FIGS. 2 and 3.

Example 6

Manufacture of Endless Belt 9

An endless belt was prepared in the same manner as the endless belt 5 except for changing the mask having the slits to one in which the slits were arranged so that the slit and a portion which is not the slit are alternately arranged in the rotation direction of the endless belt (the slit pitch of the mask: 50 μm, a ratio between the slit width and the width of a portion which is not the slit was 1:1), and adding no water-repellent silicone resin to the acrylic resin (available from JSR Corporation) used in forming the surface layer, thus obtaining the endless belt 9.

The outer peripheral surface of the endless belt 9 had a configuration substantially like those exemplified in FIGS. 2 and 3.

Example 7

Manufacture of Endless Belt 10

An endless belt was prepared in the same manner as the endless belt 5 except for changing the mask having the slits to one having a slit pitch of 20 μm (a ratio between the slit width and the width of a portion which is not the slit was 1:1), thus obtaining the endless belt 10.

The outer peripheral surface of the endless belt 10 had a configuration substantially like those exemplified in FIGS. 1 and 3.

Comparative Example 4

Manufacture of Endless Belt 11

A sheet of 50 μm in thickness made of polyvinylidene fluoride (available from Kureha Chemical Industry Co., Ltd.) having carbon black dispersed therein was wound by two turns on the outer periphery of an aluminum cylinder, followed by fitting into a SUS cylinder capable of fitting on while leaving a slight gap. The sheet was then held between the aluminum cylinder on the inner side and the SUS cylinder on the outer side.

Next, with the sheet being held between the aluminum cylinder and the SUS cylinder, the sheet was uniformly heated up to a melting temperature of polyvinylidene fluoride and then cooled, thus obtaining an endless belt base having a thickness of 100 μm. It is to be noted that the inner peripheral surface of the SUS cylinder was machined by buffing, forming a smooth, mirror-finished surface in the widthwise direction of the cylinder.

A solution of an acrylic resin (available from JSR Corporation) added with a water-repellent silicone resin was coated to the outer peripheral surface of the endless belt base by dip coating, forming a wet film. An ultraviolet ray with an illuminance of 100 mJ/cm$^2$ was then applied to the wet film, thus obtaining the endless belt 11.

A skin layer formed by localized concentration of the water-repellent silicone resin was formed in the immediate surface of the endless belt 11. The endless belt 11 has a two-layer structure consisting of the base and a surface layer (if the skin layer is also counted, the endless belt 12 has three-layer structure in total, because the surface layer can be separated into the skin layer and the other, non-skin layer).

Comparative Example 5

Manufacture of Endless Belt 12

An endless belt was prepared in the same manner as the endless belt 11 except for adding no water-repellent silicone resin to the acrylic resin (available from JSR Corporation) used in forming the surface layer, thus obtaining the endless belt 12.

(Evaluation)

Measurement of Outer Peripheral Surface Configuration of Endless Belts 1 to 12

The measurement was performed under the conditions of a measuring length of 0.8 mm and a scanning speed of 0.1 mm/s, using a contact probe surface profilometer (SE-3400 from Kosaka Laboratory Ltd.) as the measuring instrument. The configuration of the outer peripheral surface of an endless belt in the orthogonal direction (direction which crosses to the rotation direction at right angles) is one represented by a curve (roughness curve) obtained by performing scanning in the orthogonal direction. The presence/absence of shape periodicity is judged from this roughness curve, and the measurement was performed with "D" described above taken as the period and "H" described above taken as the amplitude. In the case where no shape periodicity was confirmed, the ten point height of roughness profile was used as a substitute for H.

Measurement of Contact Angle of Outer Peripheral Surface of Endless Belts 1 to 12 with Respect to Pure Water Specifically, a water droplet was produced at the needle tip of a syringe filled with pure water, and the droplet was gently placed on the outer peripheral surface of the endless belt. After moving the needle away from the droplet, the angle formed between the outer peripheral surface of the endless belt and the droplet was measured. The average of measurements made at five locations in the same manner was taken as the contact angle of the outer peripheral surface of the endless belt with respect to the pure water.

Evaluation on Cleaning Blade Entanglement Property

Each of the endless belts 1 to 12 was mounted as an intermediate transfer belt to the electrophotographic apparatus constructed as schematically shown in FIG. 5, and evaluation was made on the entanglement property of the cleaning blade used for cleaning the intermediate transfer belt.

Specifically, a 10 mm-wide band of toner was transferred onto the endless belt (intermediate transfer belt) once and then the edge of the cleaning blade for the intermediate transfer belt was put on the endless belt. The mounted endless belt (intermediate transfer belt) was caused to rotate 50 times, and the number of rotations of the endless belt (intermediate transfer belt) to the point at which the cleaning glade for the intermediate transfer belt became entangled in the endless belt (intermediate transfer belt) was measured. The measurement results were classified into the following three grades.

A: 30 rotations or more

B: 10 rotations or more and below 30 rotations

C: Below 10 rotations

Evaluation on Cleaning Performance of Cleaning Blade

Each of the endless belts 1 to 12 was mounted as an intermediate transfer belt to the electrophotographic apparatus constructed as shown in FIG. 5, and evaluation was made on the cleaning property of the cleaning blade for the intermediate transfer belt.

Specifically, a 10 mm-wide band of toner was transferred onto the endless belt (intermediate transfer belt) twice, and it was checked whether or not the entire toner can be removed with the cleaning blade. The measurement results were classified into the following four grades.

AA: It was possible to remove 100% of the toner, with the same result obtained even after repeating the cleaning 100,000 times.

A: It was possible to remove 100% of the toner.

B: It was possible to remove 95% of the toner, but part of the toner remained without being removed.

C: It was possible to remove only less than 90% of the toner, and part of the toner remained without being removed.

The evaluation results are shown in Table 1 In Table 1, "contact angle" refers to the "contact angle of the outer peripheral surface with respect to pure water" described above; "entanglement property" refers to the "cleaning blade entanglement property" described above; and "cleaning property" refers to the "cleaning property of the cleaning blade" described above.

TABLE 1

| | Endless belt | | | | | |
|---|---|---|---|---|---|---|
| | | Outer peripheral surface configuration | | Contact | | |
| | No. | D [μm] | H [μm] | angle [°] | Entanglement property | Cleaning property |
| Example 1 | 1 | 20 | 0.6 | 100 | A | A |
| Comparative example 1 | 2 | — | 0.1 | 75 | C | C |
| Comparative example 2 | 3 | — | 0.2 | 80 | C | A |
| Comparative example 3 | 4 | — | 0.1 | 75 | C | B |
| Example 2 | 5 | 200 | 0.8 | 90 | A | A |
| Example 3 | 6 | 100 | 1.0 | 95 | A | A |
| Example 4 | 7 | 100 | 0.6 | 100 | A | AA |
| Example 5 | 8 | 50 | 0.5 | 95 | A | AA |
| Example 6 | 9 | 50 | 0.5 | 75 | A | B |
| Example 7 | 10 | 20 | 0.1 | 90 | B | A |
| Comparative example 4 | 11 | — | 0.2 | 100 | C | A |
| Comparative example 5 | 12 | — | 0.2 | 75 | C | C |

Further, when evaluation was performed by using an endless belt prepared in the same manner as the endless belts 7 and 8 described above as an electrophotographic photosensitive member shaped into an endless belt (photosensitive belt) or a transfer material conveyor member shaped into an endless belt (transfer material conveyor belt), favorable results were obtained for both the entanglement property and the cleaning property.

The present invention can provide a toner image carrying member which can ensure high cleaning performance and also suppress entanglement of the cleaning blade when used in an electrophotographic apparatus employing a blade cleaning system, a method for manufacturing the toner image carrying member, and an electrophotographic apparatus equipped with the toner image carrying member.

What is claimed is:

1. A toner image carrying member on which a toner image is carried and which can be rotationally driven, wherein:

the toner image carrying member comprises a plurality of grooves formed on an outer peripheral surface of the toner image carrying member, the plurality of grooves extending along a rotation direction of the toner image carrying member, and arranged in an orthogonal direction which crosses to the rotation direction at right angles;

a configuration of the outer peripheral surface of the toner image carrying member in the orthogonal direction is a periodic uneven-configuration; and the toner image carrying member is an intermediate transfer member.

2. The toner image carrying member according to claim 1, wherein an amplitude of an unevenness of the uneven-configuration is 0.2 to 1.0 μm.

3. The toner image carrying member according to claim 1, wherein a contact angle of the outer peripheral surface with respect to pure water is not smaller than 90 degrees.

4. The toner image carrying member according to claim 1, wherein the toner image carrying member is shaped into an endless belt.

5. The toner image carrying member according to claim 1, further comprising a coating layer as an outermost layer.

6. An electrophotographic apparatus comprising an electrophotographic photosensitive member; a charging means for charging an outer peripheral surface of the electrophotographic photosensitive member; an exposure means for forming an electrostatic latent image by applying an exposure light to the outer peripheral surface of the electrophotographic photosensitive member charged by the charging means; a developing means for forming a toner image by developing the electrostatic latent image formed on the outer peripheral surface of the electrophotographic photosensitive member by the exposure means; a toner image carrying member as an intermediate transfer member that can be rotationally driven; a primary transfer member for primarily transferring to an outer peripheral surface of the intermediate transfer member the toner image formed on the outer peripheral surface of the electrophotographic photosensitive member by the developing means; and a secondary transfer member for secondarily transferring to a transfer material the toner image on the outer peripheral surface of the intermediate transfer member primarily transferred by the primary transfer member, wherein the toner image carrying member comprises a plurality of grooves formed on an outer peripheral surface of the toner image carrying member, the plurality of grooves extending along a rotation direction of the toner image carrying member and arranged in an orthogonal direction which crosses to the rotation direction at right angles, and a configuration of the outer peripheral surface of the toner image carrying member in the orthogonal direction is a periodic uneven-configuration.

7. The electrophotographic apparatus according to claim 6, further comprising a cleaning means for cleaning a toner from the outer peripheral surface of the toner image carrying member.

8. The electrophotographic apparatus according to claim 7, wherein the cleaning means comprises a cleaning blade arranged so as to contact on the outer peripheral surface of the toner image carrying member.

* * * * *

UNITED STATES PATENT AND TRADEMARK OFFICE

CERTIFICATE OF CORRECTION

PATENT NO. : 7,266,329 B2
APPLICATION NO. : 10/950388
DATED : September 4, 2007
INVENTOR(S) : Yasuhiro Matsuo et al.

It is certified that error appears in the above-identified patent and that said Letters Patent is hereby corrected as shown below:

ON THE TITLE PAGE:
At Item (56), References Cited, Foreign Patent Document, "JP 04303870 A * 10/1992" should read --JP 4-303870 10/1992--, and "JP 2005082327 A * 3/2005" should read --JP 2005-082327 3/2005--.

COLUMN 4:
Line 51, "for provide" should read --to provide--.
Line 58, "outmost" should read --outermost--.

COLUMN 5:
Line 11, "the binding" should read --binding--.

COLUMN 6:
Line 24, "is a yellow" should read --a yellow--.

COLUMN 7:
Line 39, "putting" should read --put--.
Line 58, "carried" should read --carries--.

COLUMN 8:
Line 52, "ous." should read --ously.--.

COLUMN 9:
Line 67, "belt has" should read --belt 5 has--.

COLUMN 10:
Line 1, "three-layer" should read --a three-layer--.

COLUMN 11:
Line 48, "three-layer" should read --a three-layer--.

COLUMN 12:
Line 38, "glade" should read --blade--.

UNITED STATES PATENT AND TRADEMARK OFFICE

CERTIFICATE OF CORRECTION

PATENT NO. : 7,266,329 B2
APPLICATION NO. : 10/950388
DATED : September 4, 2007
INVENTOR(S) : Yasuhiro Matsuo et al.

It is certified that error appears in the above-identified patent and that said Letters Patent is hereby corrected as shown below:

COLUMN 13:
Line 1, "Table 1 In Table" should read --Table 1. In Table--.

Signed and Sealed this

Sixth Day of May, 2008

JON W. DUDAS
*Director of the United States Patent and Trademark Office*